US011118842B2

(12) United States Patent
Ojiro

(10) Patent No.: US 11,118,842 B2
(45) Date of Patent: Sep. 14, 2021

(54) HEAT EXCHANGER WITH A PLURALITY OF NON-COMMUNICATING GAS VENTS

(71) Applicant: RINNAI CORPORATION, Aichi (JP)

(72) Inventor: Takashi Ojiro, Aichi (JP)

(73) Assignee: RINNAI CORPORATION, Aichi (JP)

( * ) Notice: Subject to any disclaimer, the term of this patent is extended or adjusted under 35 U.S.C. 154(b) by 89 days.

(21) Appl. No.: 16/503,961

(22) Filed: Jul. 5, 2019

(65) Prior Publication Data

US 2020/0049413 A1 Feb. 13, 2020

(30) Foreign Application Priority Data

Aug. 9, 2018 (JP) ..... JP2018-150471

(51) Int. Cl.

| | |
|---|---|
| ***F28F 13/12*** | (2006.01) |
| ***F28F 3/04*** | (2006.01) |
| ***F28D 9/00*** | (2006.01) |
| *F28D 21/00* | (2006.01) |

(52) U.S. Cl.

CPC ..... *F28D 9/0043* (2013.01); *F28F 13/12* (2013.01); *F28D 9/005* (2013.01); *F28D 9/0037* (2013.01); *F28D 9/0075* (2013.01); *F28D 2021/0024* (2013.01); *F28F 3/044* (2013.01); *F28F 3/046* (2013.01)

(58) Field of Classification Search

CPC ..... F28D 9/0043; F28D 9/0037; F28D 9/005; F28D 9/0075; F28F 13/12; F28F 3/044; F28F 3/046

USPC ..... 165/167, 109.1

See application file for complete search history.

(56) References Cited

U.S. PATENT DOCUMENTS

| | | | | |
|---|---|---|---|---|
| 2,354,865 | A * | 8/1944 | Kucher | F28D 1/0333 165/148 |
| 4,561,494 | A * | 12/1985 | Frost | F28F 9/0224 165/76 |
| 6,250,380 | B1 * | 6/2001 | Strahle | F28D 9/0043 165/167 |
| 7,681,629 | B2 * | 3/2010 | Yamaguchi | F28D 9/0037 165/166 |
| 7,857,039 | B2 * | 12/2010 | Nakamura | F02M 26/32 165/157 |
| 2009/0314475 | A1 * | 12/2009 | Jeon | F28F 1/42 165/109.1 |

(Continued)

FOREIGN PATENT DOCUMENTS

| | | |
|---|---|---|
| KR | 101389465 B1 * | 4/2014 |
| KR | 10-1608149 | 3/2016 |

OTHER PUBLICATIONS

Translation of Korean Patent Document KR 101389465 B1 entitled Translation-KR 101389465 B1 (Year: 2020).*

*Primary Examiner* — Paul Alvare

(74) *Attorney, Agent, or Firm* — Wenderoth, Lind & Ponack, L.L.P.

(57) ABSTRACT

The heat exchanger (1) has a plurality of heat exchange units (10) stacked in a direction of a gas flow passage of combustion exhaust gas, each of the heat exchange units (10) includes an internal space (14) through which a fluid to be heated flows, a plurality of gas vents (13) penetrating the internal space (14) in a non-communicating state and through which the combustion exhaust gas passes, and an inwardly directed step portion (17) reducing a height of the internal space (14) between adjacent gas vents (13).

6 Claims, 6 Drawing Sheets

(56) References Cited

U.S. PATENT DOCUMENTS

2011/0277494 A1* 11/2011 Kikuno ..... F28F 3/02
62/324.1
2012/0325446 A1* 12/2012 Wakamatsu ..... F28D 9/0012
165/167
2017/0184350 A1* 6/2017 Choi ..... F28D 9/0037

* cited by examiner

HEAT EXCHANGER WITH A PLURALITY OF NON-COMMUNICATING GAS VENTS

FIELD OF THE INVENTION

The present invention relates to a heat exchanger including a plurality of heat exchange units, each of which having an internal space through which a fluid to be heated flows and a plurality of gas vents penetrating the internal space in a non-communicating state.

DESCRIPTION OF THE RELATED ART

Conventionally, a heat exchanger including a stacked body formed by stacking a plurality of heat exchange units in which an upper heat exchange plate and a lower heat exchange plate are joined has been proposed (for example, Patent Prior Art 1: KR 10-1608149 A). Each of the heat exchange units has an internal space through which a fluid to be heated flows between the upper heat exchange plate and the lower heat exchange plate, and a plurality of gas vents penetrating the internal space in a non-communicating state and through which combustion exhaust gas from a burner passes in a vertical direction.

In the heat exchange unit as described above, a peripheral portion of the gas vent through which the combustion exhaust gas passes is most heated. Therefore, in order to efficiently transfer heat absorbed by the heat exchange unit to the fluid to be heated to enhance thermal efficiency, a structure of the heat exchange unit in which as much fluid to be heated as possible flows near the peripheral portion of the gas vent is preferable.

However, in the heat exchanger described above, since the gas vent through which the combustion exhaust gas passes penetrates the internal space in the non-communicating state, a flange portion having a certain width for closing the internal space is formed at the peripheral portion of the gas vent. Thus, a certain distance is formed between the gas vent and the internal space through which the fluid to be heated flows. In addition, since the internal space is closed at the flange portion, flow resistance near the flange portion in the internal space is higher than that in an area away from the flange portion. Therefore, the fluid to be heated easily flows in the area away from the flange portion. As a result, there is a problem that heat of the combustion exhaust gas is not efficiently transferred to the fluid to be heated flowing through the internal space.

SUMMARY OF INVENTION

The present invention has been made to solve the problem described above, and an object of the present invention is to improve thermal efficiency of a heat exchanger including a plurality of heat exchange units, each of which having an internal space through which a fluid to be heated flows and a plurality of gas vents penetrating the internal space in a non-communicating state.

According to the present invention, there is provided a heat exchanger comprising a plurality of heat exchange units stacked in a direction of a gas flow passage of combustion exhaust gas, wherein each of the plurality of heat exchange units includes:

an internal space through which a fluid to be heated flows;

a plurality of gas vents penetrating the internal space in a non-communicating state and through which the combustion exhaust gas passes; and an inwardly directed step portion reducing a height of the internal space between adjacent gas vents.

Other objects, features and advantages of the present invention will become more fully understood from the detailed description given hereinbelow and the accompanying drawings which are given by way of illustration only, and thus are not to be considered as limiting the present invention.

DESCRIPTION OF EMBODIMENTS

Hereinafter, referring to drawings, a heat exchanger and a heat source device using thereof according to an embodiment of the present invention will be described in detail.

Figure 1:
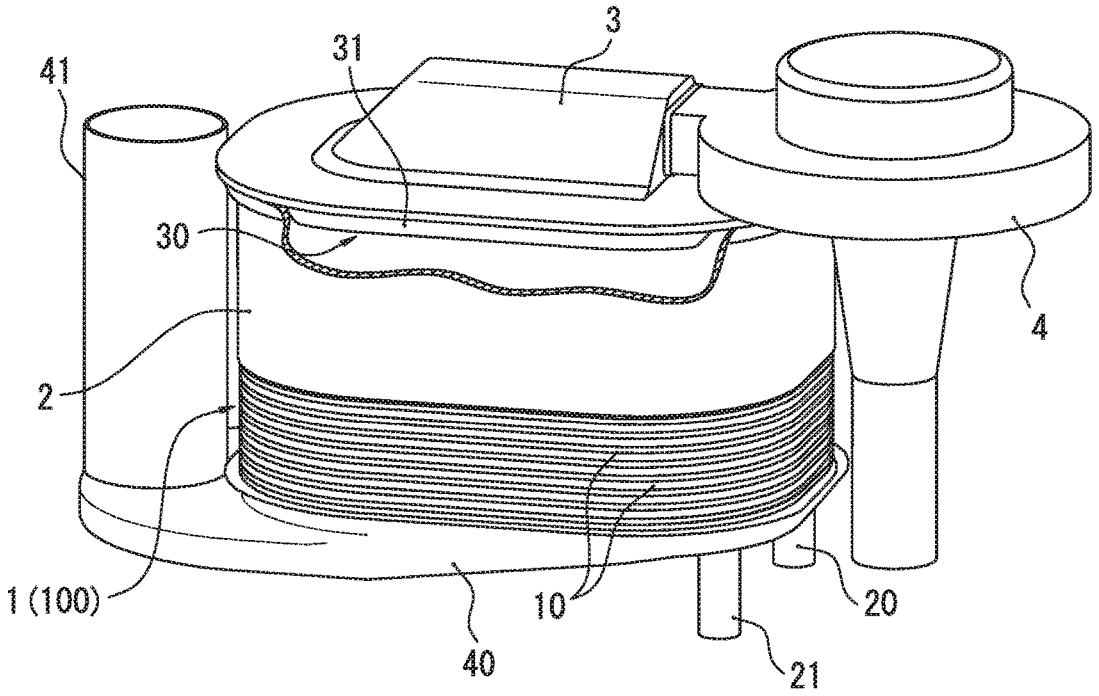
FIG. 1 is a schematic partial cut-away perspective view showing a heat source device according to an embodiment of the present invention.

As illustrated in FIG. 1, a heat source device according to the present embodiment is a water heater that heats water (a fluid to be heated) flowing into a heat exchanger 1 from an inlet pipe 20 by combustion exhaust gas generated by a burner 31, and supplies the heated water to a hot water supplying terminal (not illustrated) such as a faucet or a shower through an outlet pipe 21. Although not shown, the water heater is accommodated in an outer casing. Other heating medium (for example, an antifreezing fluid) as the fluid to be heated may be used.

In this water heater, a burner body 3 constituting an outer shell of the burner 31, a combustion chamber 2, the heat exchanger 1, and a drain receiver 40 are arranged in order from the top. Additionally, a fan case 4 housing a combustion fan for feeding a mixture gas of fuel gas and air into the burner body 3 is disposed on one side (a right side in FIG. 1) of the burner body 3. Further, an exhaust duct 41 communicating with the drain receiver 40 is disposed on another side (a left side in FIG. 1) of the burner body 3. The combustion exhaust gas flowing out to the drain receiver 40 is discharged to an outside of the water heater through the exhaust duct 41.

In this specification, when the water heater is viewed in a state where the fan case 4 and the exhaust duct 41 are disposed on the sides of the burner body 3, a depth direction corresponds to a front-rear direction, a width direction corresponds to a left-right direction, and a height direction corresponds to a vertical direction.

The burner body 3 has a substantially oval shape in a plane view. The burner body 3 is made of stainless steel-based metal, for example. Although not shown, the burner body 3 opens downward.

An introducing unit communicating with the fan case 4 projects upward from a center of the burner body 3. The burner body 3 includes a flat burner 31 having a downward combustion surface 30. The mixture gas is supplied to the burner body 3 by rotating the combustion fan.

The burner 31 is of all primary air combustion type. The burner 31 includes a ceramic combustion plate having many flame ports opening downwardly (not shown) or a combustion mat made by knitting metal fabric woven like net. The mixture gas supplied into the burner body 3 is jetted downward from the downward combustion surface 30 by supply pressure of the combustion fan. By igniting the mixture gas, flame is formed on the combustion surface 30 of the burner 31 and the combustion exhaust gas is generated. Therefore, the combustion exhaust gas ejected from the burner 31 is fed to the heat exchanger 1 via the combustion chamber 2. Then, the combustion exhaust gas having passed through the heat exchanger 1 passes through the drain receiver 40 and the exhaust duct 41 and is discharged to the outside of the water heater.

In other words, in the heat exchanger 1, an upper side where the burner 31 is provided corresponds to an upstream side of a gas flow passage of the combustion exhaust gas, and a lower side opposite to the side provided with the burner 31 corresponds to a downstream side of the gas flow passage of the combustion exhaust gas.

Figure 3:
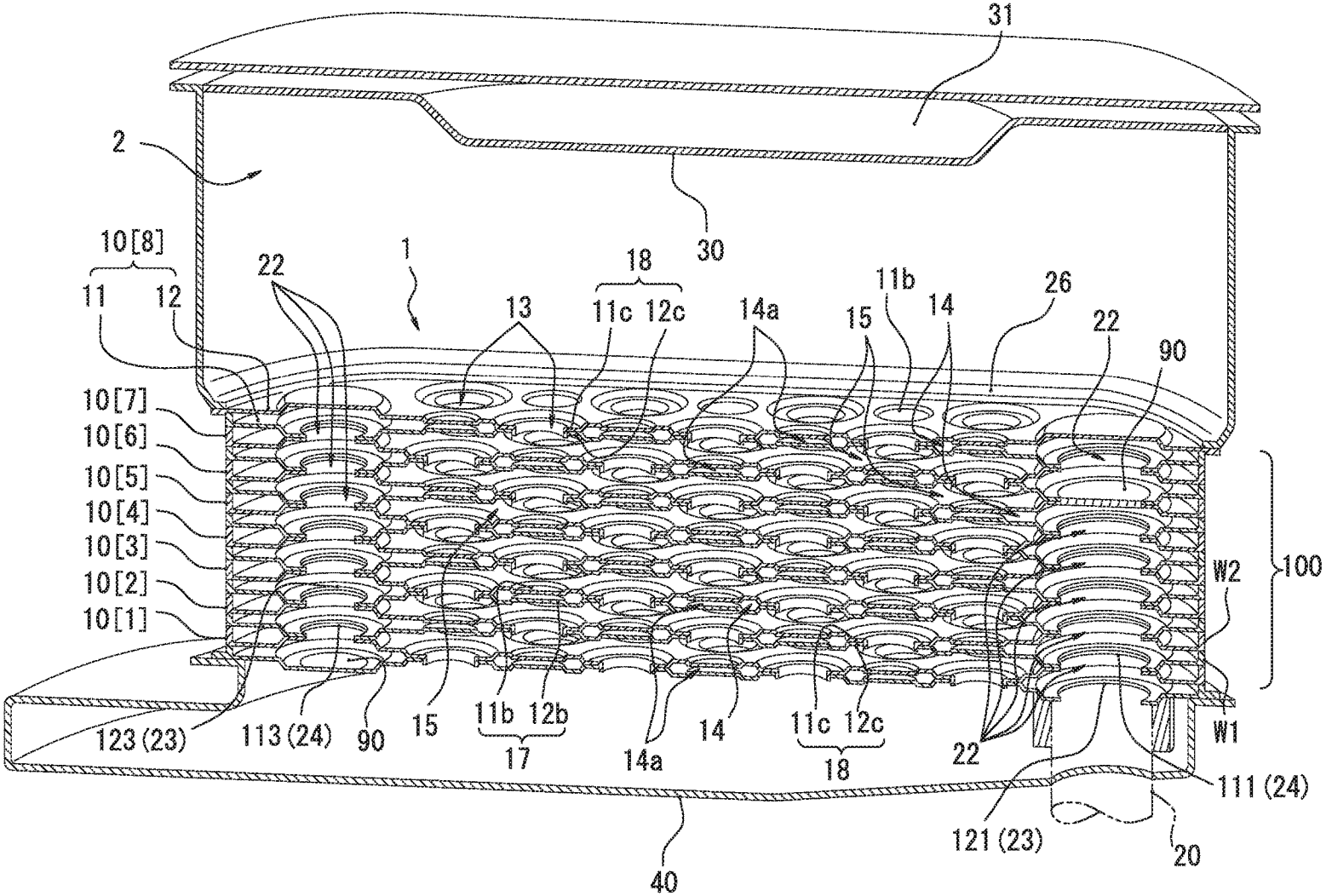
FIG. 3 is a schematic partial cross-sectional perspective view of an inlet pipe side showing the heat exchanger according to the embodiment of the present invention.

The combustion chamber 2 has a substantially oval shape in a plane view. The combustion chamber 2 is made of stainless steel-based metal, for example. The combustion chamber 2 having an upper opening and a lower opening is formed by bending one single metal plate having a substantially rectangular shape and joining both ends thereof. As illustrated in FIG. 3, a flange 26 bent inward is formed at a lower end of the combustion chamber 2. The flange 26 is joined to an upper peripheral edge of the heat exchanger 1.

Figure 4:
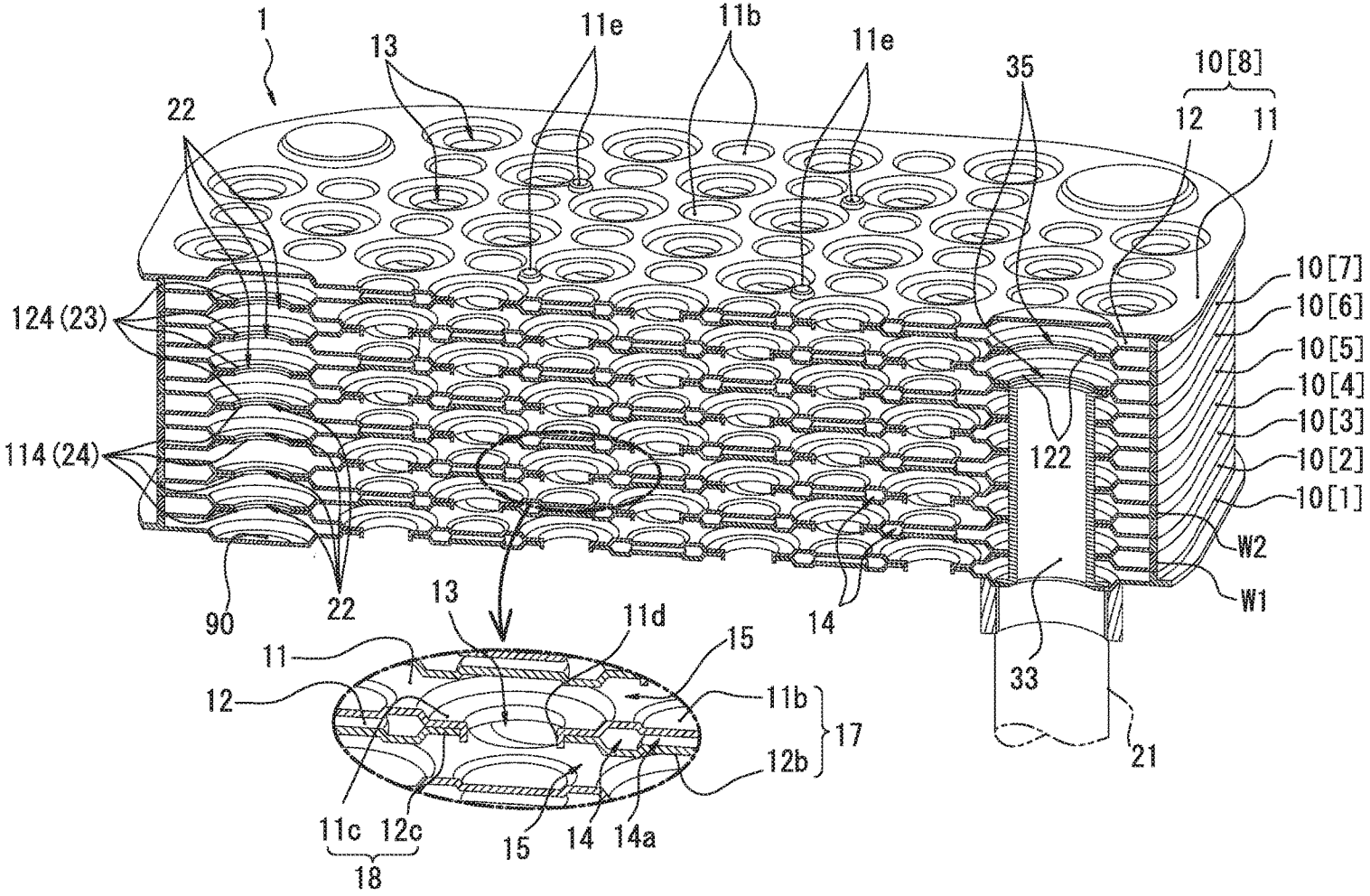
FIG. 4 is a schematic partial cross-sectional perspective view of an outlet pipe side showing the heat exchanger according to the embodiment of the present invention.

The heat exchanger 1 has a substantially oval shape in a plane view. As illustrated in FIGS. 3 and 4, the heat exchanger 1 has a stacked body 100 formed by stacking a plurality of (in this embodiment, eight) thin plate heat exchange units 10. The heat exchanger 1 may have a housing surrounding an outer circumference thereof.

Each of the heat exchange units 10 is formed by superimposing a pair of upper and lower heat exchange plates 11, 12 in the vertical direction and joining predetermined portions to be described later with brazing material or the like. The upper and lower heat exchange plates 11, 12 of each of the heat exchange units 10 respectively have a common configuration, except that part of configuration such as a position of a gas vent is different. Thus, the common configuration will be described first, and different configuration will be described later. For clarity sake, the dimensions of elements which are represented in the figures do not correspond to the actual dimensions, and do not limit the embodiment.

Figure 2:
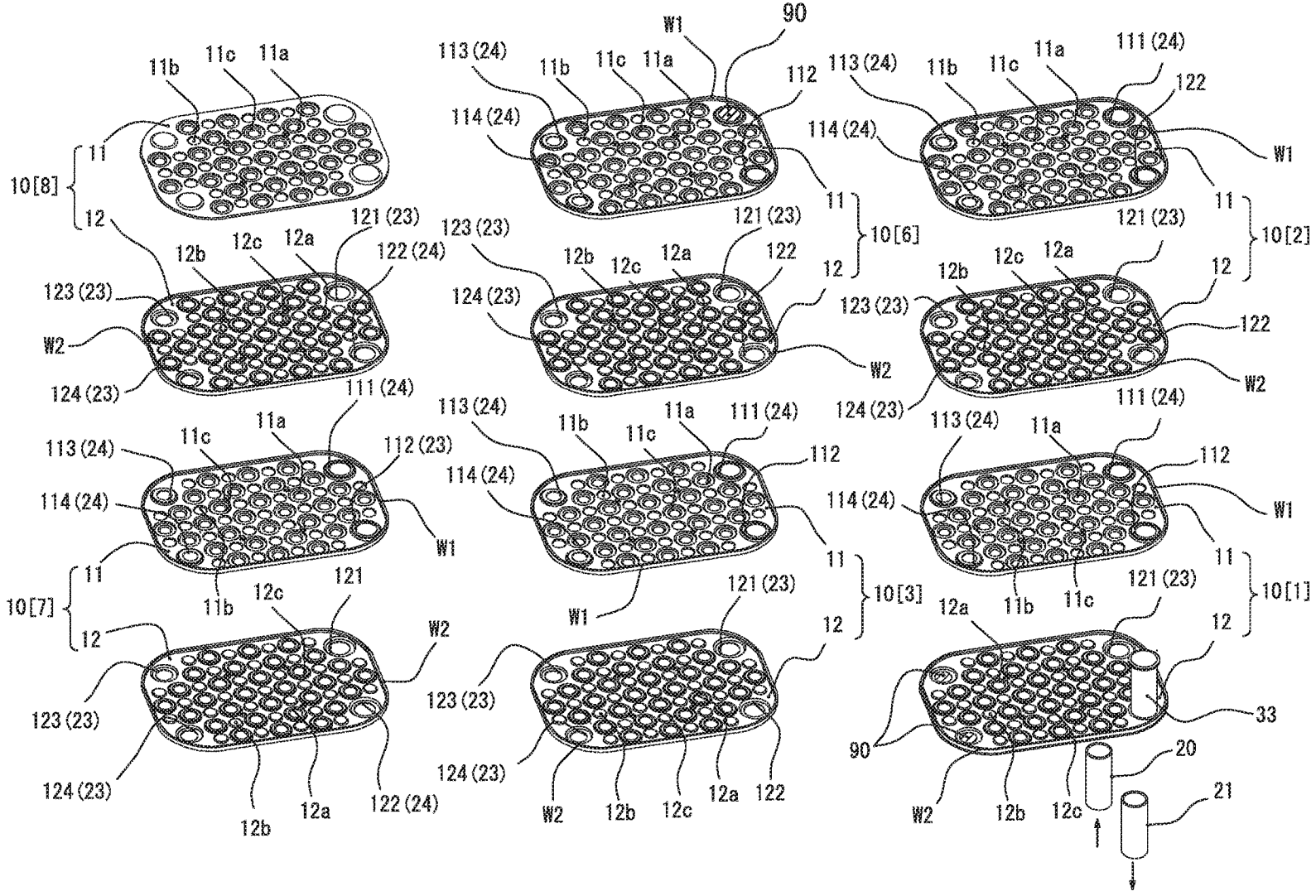
FIG. 2 is a schematic partial exploded perspective view showing heat exchange units of an heat exchanger according to the embodiment of the present invention.

As illustrated in FIG. 2, the upper and lower heat exchange plates 11, 12 respectively have a substantially oval shape in a plane view. The upper and lower heat exchange plates 11, 12 are made of stainless steel-based metal, for example. The upper and lower heat exchange plates 11, 12 respectively have a number of substantially circular upper and lower gas vents 11*a*, 12*a* and a number of substantially circular upper and lower recesses 11*b*, 12*b* projecting inward when the upper and lower heat exchange plates 11, 12 are superimposed with each other, on substantially entire surfaces of the plates except for corners. The upper and lower gas vents 11*a*, 12*a* and the upper and lower recesses 11*b*, 12*b* may have other shapes such as oval or rectangular, respectively.

Except for an uppermost upper heat exchange plate 11, on peripheral edges of the upper and lower heat exchange plates 11, 12, upper and lower peripheral edge joints W1, W2 projecting upward are respectively formed. The lower peripheral edge joint W2 of the lower heat exchange plate 12 is set in such a manner that when the lower peripheral edge joint W2 and a bottom surface peripheral edge of the upper heat exchange plate 11 are joined, the upper and lower heat exchange plates 11, 12 are space from each other at a gap with a predetermined height. Note that, although not illustrated, an upper peripheral edge joint projecting downward is formed on a bottom surface peripheral edge of the uppermost upper heat exchange plate 11. This upper peripheral edge joint is formed in such a manner that the lower peripheral edge joint W2 of an uppermost lower heat exchange plate 12 is fitted in the upper peripheral edge joint.

Further, the upper peripheral edge joint W1 of the upper heat exchange plate 11 is set in such a manner that when the upper peripheral edge joint W1 and a bottom surface peripheral edge of the lower heat exchange plate 12 of an upward adjacent heat exchange unit 10 are joined, the upper heat exchange plate 11 of the lower heat exchange unit 10 and the lower heat exchange plate 12 of the upper heat exchange unit 10 are spaced from each other at a gap with a predetermined height. Therefore, by joining the lower peripheral edge joint W2 of the lower heat exchange plate 12 and the bottom peripheral edge of the upper heat exchange plate 11, in planar regions where the upper and lower recesses 11*b*, 12*b* as well as upper and lower projections and upper and lower through holes, which will be described later, are not formed, an internal space 14 having a predetermined height (for example, approximately 2 mm) is formed (see FIGS. 3 and 4). Further, by joining the plurality of heat exchange units 10, an exhaust space 15 is formed between vertically adjacent heat exchange units 10 (see FIGS. 3 and 4). The exhaust space 15 has a predetermined height (for example, approximately 3 mm) in the planar regions.

The upper and lower gas vents 11*a*, 12*a* are bored in a lattice pattern at predetermined intervals in the front-rear and left-right directions over substantially the entire surfaces of the upper and lower heat exchange plates 11, 12 except for four corners. Further, upper and lower gas vent flange portions 11*c*, 12*c* extending horizontally with a predetermined width are formed at peripheral portions of the upper and lower gas vents 11*a*, 12*a*, respectively. The upper and lower gas vents 11*a*, 12*a* and the upper and lower gas vent flange portions 11*c*, 12*c* are formed at positions corresponding to each other in the vertical direction when the upper and lower heat exchange plates 11, 12 are superimposed with each other. Furthermore, the upper and lower gas vents 11*a*, 12*a* and the upper and lower gas vent flange portions 11*c*, 12*c* are formed on a bottom of a step portion projecting with a predetermined height (for example, approximately 1 mm) toward the opposing upper and lower heat exchange plates 11, 12 when the upper and lower heat exchange plates 11, 12 are superimposed with each other. Moreover, the upper gas vent 11*a* is formed by burring. Therefore, as illustrated in FIGS. 3 and 4, when the upper and lower heat exchange plates 11, 12 are superimposed with each other and predetermined portions are joined by brazing material or the like, flange portions 18 closing the internal space 14 are formed by the upper and lower gas vent flange portions 11*c*, 12*c*, and the gas vents 13 penetrating the internal space 14 in a non-communicating state are formed by the upper and lower gas vents 11*a*, 12*a*. Further, a burring portion 11*d* projecting from an opening edge of the gas vent 13 to be lower than the lower gas vent flange portion 12*c* (on the downstream side of the gas flow passage of the combustion exhaust gas) is formed at an inner end of the upper gas vent flange portion 11*c*.

The substantially circular upper and lower recesses 11*b*, 12*b* are respectively formed between two upper and lower gas vents 11*a*, 12*a* adjacent to each other in the front-rear and left-right directions. In addition, the upper and lower recesses 11*b*, 12*b* are formed at positions corresponding to each other in the vertical direction when the upper and lower heat exchange plates 11, 12 are superimposed with each other. Therefore, the upper and lower recesses 11*b*, 12*b* are formed in a lattice pattern at predetermined intervals in the front-rear and left-right directions over substantially the entire surfaces of the upper and lower heat exchange plates 11, 12 except for the four corners. Further, the interval in the front-rear and left-right directions between the adjacent upper and lower recesses 11*b*, 12*b* is set to be substantially the same as that between the adjacent upper and lower gas vents 11*a*, 12*a*. Thus, the upper and lower gas vents 11*a*, 12*a* and the upper and lower recesses 11*b*, 12*b* are alternately formed at substantially equal intervals in the front-rear and left-right directions. In addition, the upper and lower gas vents 11*a*, 12*a* and the upper and lower recesses 11*b*, 12*b* are successively arranged at predetermined intervals in a direction inclining at a predetermined angle with respect to the front-rear and left-right directions. Further, the upper and lower recesses 11*b*, 12*b* are formed in such a manner that each of the upper and lower recesses 11*b*, 12*b* is located at a substantially center of a region surrounded by four adjacent upper and lower gas vents 11*a*, 12*a* in the front-rear and left-right directions except for the peripheral edges of the upper and lower heat exchange plates 11, 12. Each of the upper and lower recesses 11*b*, 12*b* has a diameter smaller than a distance between the two adjacent upper and lower gas vent flange portions 11*c*, 12*c* in the front-rear and left-right directions.

The upper and lower recesses 11*b*, 12*b* are formed so as to project by a predetermined height (for example, approximately 0.5 mm) inwardly of the internal space 14 when the upper and lower heat exchange plates 11, 12 are superimposed with each other. An inwardly projecting height of each of the upper and lower recesses 11*b*, 12*b* is set to be lower than that of the upper and lower gas vent flange portions 11*c*, 12*c*. Therefore, as illustrated in FIGS. 3 and 4, when the upper and lower heat exchange plates 11, 12 are superimposed with each other, an inwardly directed step portion 17 reducing the height of the internal space 14 is formed by the upper and lower recesses 11*b*, 12*b*, and an narrow internal space 14*a* having a predetermined height (for example, approximately 1 mm) is formed between the upper and lower recesses 11*b*, 12*b*. Further, a fluid flow path of water is formed between the inwardly directed step portion 17 and an adjacent flange portion 18. Preferably, the narrow internal space 14*a* has a height of 20 to 70% of the height of the internal space 14 in the planar regions. Note that the inwardly directed step portion 17 may be formed by one of the upper and lower recesses 11*b*, 12*b*.

Figure 6:
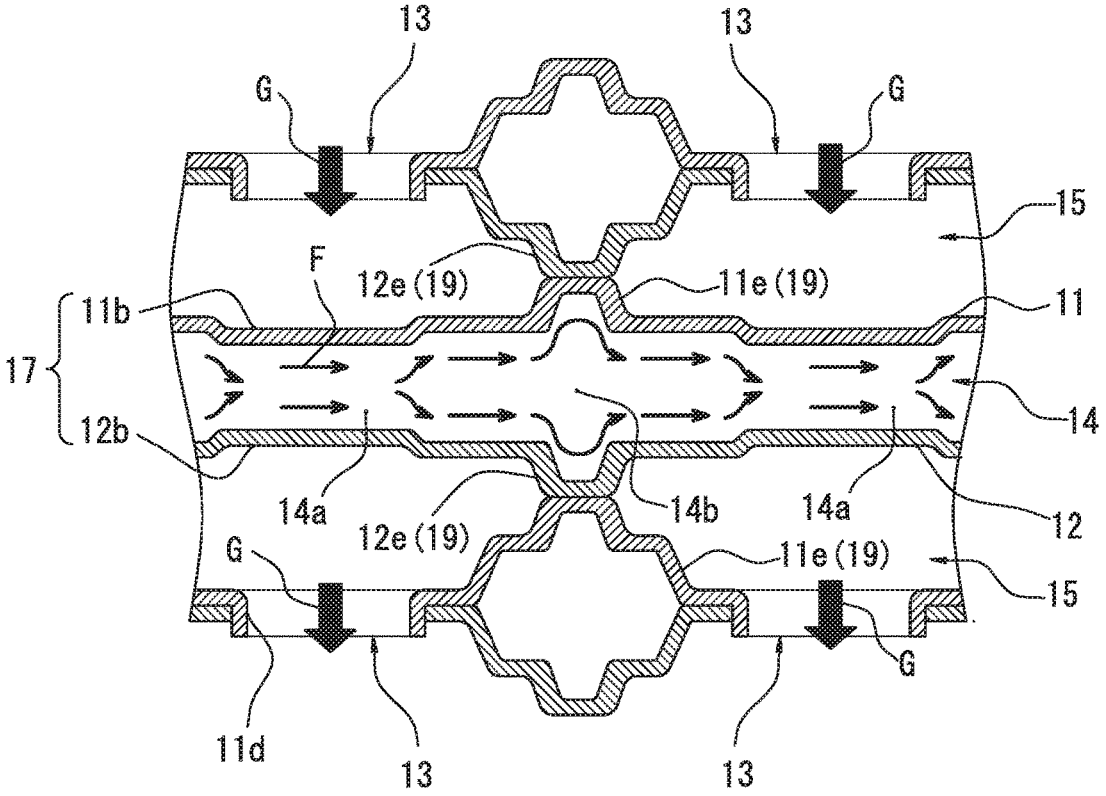
FIG. 6 is a schematic enlarged partial cross-sectional view showing the heat exchanger according to the embodiment of the present invention.

At a center in the front-rear and left-right directions of the upper and lower heat exchange plates 11, 12, four substantially small circular upper and lower projections 11*e*, 12*e* projecting outward when the upper and lower heat exchange plates 11, 12 are superimposed with each other are formed (see FIG. 6). The upper and lower projections 11*e*, 12*e* of a pair of upper and lower heat exchange plates 11, 12 forming one heat exchange unit 10 are respectively formed at positions mutually corresponding to the lower projection 12*e* of the lower heat exchange plate 12 of an upward adjacent heat exchange unit 10 and the upper projection 11*e* of the upper heat exchange plate 11 of an downward adjacent heat exchange unit 10. The four upper and lower projections 11*e*, 12*e* are arranged in a substantially square pattern in such a manner that two upper and lower gas vents 11*a*, 12*a* or two upper and lower recesses 11*b*, 12*b* are located therebetween in the front-rear and left-right directions. Further, as described above, the upper and lower gas vents 11*a*, 12*a* and the upper and lower recesses 11*b*, 12*b* are successively arranged at the predetermined intervals in the direction inclining at the predetermined angle with respect to the front-rear and left-right directions. Thus, each of the upper and lower projections 11*e*, 12*e* is surrounded by two adjacent upper and lower gas vents 11*a*, 12*a* and two adjacent upper and lower recesses 11*b*, 12*b*. Specifically, each of the upper and lower projections 11*e*, 12*e* is formed at a substantially center of a region surrounded by two successively adjacent upper and lower gas vents 11*a*, 12*a* in the one inclined direction and two successively adjacent upper and lower recesses 11*b*, 12*b* in the inclined direction intersecting the one direction.

Each of the upper and lower projections 11*e*, 12*e* has substantially the same diameter as the shortest distance between adjacent upper and lower gas vent flange portions 11*c*, 12*c* surrounding the upper and lower projections 11*e*, 12*e*. Further, each of the upper and lower projections 11*e*, 12*e* has an outwardly projecting height (for example, approximately 1.5 mm) that is approximately a half of the height of the exhaust space 15 when the adjacent heat exchange units 10 are stacked with each other. Therefore, as illustrated in FIG. 6, when the upper and lower heat exchange plates 11, 12 are superimposed with each other, an outwardly directed step portion 19 increasing the height of the internal space 14 is formed by the upper and lower projections 11*e*, 12*e*, and a wide internal space 14*b* having a predetermined height (for example, approximately 4 mm) is formed between the upper and lower projections 11*e*, 12*e*. Preferably, the wide internal space 14*b* has a height of 150 to 250% of the height of the internal space 14 in the planar regions. When the adjacent heat exchange units 10 are stacked with each other, the lower projection 12*e* of the lower heat exchange plate 12 of the upper heat exchange unit 10 and the upper projection 11*e* of the upper heat exchange plate 11 of the downward adjacent heat exchange unit 10 are in contact with each other, thereby forming a support part for holding the exhaust space 15. Note that the outwardly directed step portion 19 may be formed by one of the upper and lower projections 11*e*, 12*e*. Further, in accordance with a size of the heat exchange unit 10, the upper and lower projections 11*e*, 12*e* may be formed three or less or five or more. Furthermore, the upper and lower projections 11*e*, 12*e* may have other shapes such as oval or rectangular.

The upper and lower heat exchange plates 11, 12, except for the upper heat exchange plate 11 of the uppermost heat exchange unit 10, have substantially circular upper and lower through holes 111 to 114, 121 to 124 in respective corners. The upper and lower through holes 111 to 114, 121 to 124 located in the same corner of the upper and lower heat exchange plates 11, 12 of the heat exchange units 10 are opened so as to be located on a coaxial line when the upper and lower heat exchange plates 11, 12 are superimposed with each other. In addition, upper and lower through hole flange portions (not illustrated) having a predetermined width and extending horizontally are formed at peripheral portions of the upper and lower through holes 111 to 114, 121 to 124. The upper and lower through hole flange portions are formed at positions corresponding to each other in the vertical direction when the adjacent heat exchange units 10 are stacked with each other. Further, the upper and lower through hole flange portions are formed so as to project outward at a predetermined height (for example, approximately 1.5 mm) when the upper and lower heat exchange plates 11, 12 are superimposed with each other. Thus, the upper and lower through hole flange portions are joined by a brazing material or the like when the adjacent heat exchange units 10 are stacked with each other, so that the upper and lower through hole flange portions form a part of a joint joining the adjacent heat exchange units 10. Further, as described later, when the adjacent heat exchange units 10 are stacked and joined to each other, communication paths 22, 35 penetrating the exhaust space 15 between the adjacent heat exchange units 10 in a non-communicating state and allowing the internal spaces 14 of the adjacent heat exchange units 10 to communicate with each other are formed by the upper and lower through hole flange portions.

The gas vents 13 of the vertically adjacent heat exchange units 10 are shifted by a half pitch in the left-right direction perpendicularly intersecting a gas flow passage direction of the combustion exhaust gas. Therefore, the combustion exhaust gas flowing from above passes through the gas vent 13 of the one heat exchange unit 10, and then flows out to the exhaust space 15 between the one heat exchange unit 10 and the downward adjacent heat exchange unit 10. Then, the combustion exhaust gas flowing out to the exhaust space 15 collides with the upper heat exchange plate 11 of the downward adjacent heat exchange unit 10 and further flows downward from the gas vent 13 of the downward adjacent heat exchange unit 10. In other words, when the combustion exhaust gas flows from an upper side to a lower side in the stacked body 100, a zigzag-shaped exhaust passage is formed in the stacked body 100. As a result, in the heat exchanger 1, a contact time between the combustion exhaust gas and the upper and lower heat exchange plates 11, 12 increases.

Next, the heat exchange unit 10 in each layer will be described with reference to FIGS. 2 to 4. A number in a square bracket ([ ]) on a right side of the heat exchange unit 10 in FIGS. 2 and 4 indicates the number of layers from the bottom when the lowermost heat exchange unit 10 is a first layer. Note that in FIG. 2, configurations of fourth and fifth heat exchange units 10 are the same as those of the second and third heat exchange units 10, respectively, and hence omitted.

A lower heat exchange plate 12 which is an element of a first (lowermost) heat exchange unit 10 has lower through holes 121 to 124 at respective corners. Among these lower through holes 121 to 124, the two lower through holes 123, 124 each (not illustrated) in front and rear corners on a left side are sealed with a lid member 90. Further, an upper heat exchange plate 11 of the first heat exchange unit 10 has upper through holes 111 to 114 in four corners.

Further, at peripheral portions of the upper and lower through holes 111 to 114, 121 to 124 in the four corners of the first upper and lower heat exchange plates 11, 12, upper and lower through hole flange portions that project outward when the upper and lower heat exchange plates 11, 12 are superimposed with each other are formed. Further, at the peripheral portion of the lower through hole 122 (not illustrated) in a front corner on a right side of the lower heat exchange plate 12, a lower end of a lead-out pipe 33 penetrating internal spaces 14 of first to sixth heat exchange units 10 and exhaust spaces 15 between these heat exchange units 10 is connected (see FIG. 4). Although not illustrated, connecting joints for connecting the inlet pipe 20 and the outlet pipe 21 are respectively provided at the peripheral portions of the lower through holes 121, 122 on a lower surface of the first lower heat exchange plate 12.

Therefore, when upper and lower gas vent flange portions 11*c*, 12*c* of the upper and lower heat exchange plates 11, 12 forming the first heat exchange unit 10 are joined and a lower peripheral edge joint W2 of the lower heat exchange plate 12 and a bottom peripheral edge of the upper heat exchange plate 11 are joined, an internal space 14 of the first heat exchange unit 10 communicates with the lower through hole 121 in a rear corner on the right side of the lower heat exchange plate 12 and communicates with the three upper through holes 111, 113, 114 in the rear corner on the right side and the front and rear corners on the left side of the upper heat exchange plate 11.

Further, the lead-out pipe 33 extending upward from the lower through hole 122 in the front corner on the right side of the lower heat exchange plate 12 forms a fluid flow path which is defined in a non-communicating state with the internal space 14 (see FIG. 4). Therefore, when the inlet pipe 20 is connected to the lower through hole 121 in the rear corner on the right side of the lower heat exchange plate 12 via the connecting joint, water flows into the internal space 14 of the first heat exchange unit 10 from the inlet pipe 20 via the lower through hole 121. Then, the water flows out upward from the internal space 14 via the three upper through holes 111, 113, 114 in the rear corner on the right side and the front and rear corners on the left side of the upper heat exchange plate 11.

That is, in the first heat exchange unit 10, the one lower through hole 121 in the rear corner on the right side of the lower heat exchange plate 12 serves as an inlet port 23 through which the water flows into the internal space 14. In addition, the three upper through holes 111, 113, 114 in the rear corner on the right side and the front and rear corners on the left side of the upper heat exchange plate 11 serve as outlet ports 24 through which the water flows out from the internal space 14.

In the first heat exchange unit 10, gas vents 13 are arranged in a lattice pattern in the front-rear and left-right directions, and the internal space 14 is closed by flange portions 18 at peripheral portions of the gas vents 13. Thus, part of the water flowing into the internal space 14 from the inlet port 23 flows to the two outlet ports 24 on the left side distant from each other in the front-rear direction while colliding with the flange portions 18. Therefore, the water flowing through the internal space 14 spreads in the entire internal space 14. As a result, the water easily flows to both ends in the front-rear direction of the internal space 14. Thus, the water is efficiently heated. In addition, since a curved flow is formed, a fluid flow path becomes longer. As a result, a heat absorption time increases, and thermal efficiency improves.

In second to fifth heat exchange units 10, the heat exchange units 10 have the same configuration, except that gas vents 13 and inwardly directed step portions 17 are respectively shifted by a half pitch in the left-right direction from those of the vertically adjacent heat exchange units 10.

Further, upper and lower heat exchange plates 11, 12 of these heat exchange units 10 have four upper through holes 111 to 114 and four lower through holes 121 to 124 at substantially the same positions as the upper through holes 111 to 114 in the four corners of the first upper heat exchange plate 11. In addition, similarly to the first upper and lower heat exchange plates 11, 12, upper and lower through hole flange portions that project outward when the upper and lower heat exchange plates 11, 12 are superimposed with each other are formed at peripheral portions of the upper and lower through holes 111 to 114, 121 to 124 at the four corners of the upper and lower heat exchange plates 11, 12. Further, the lead-out pipe 33 is inserted into the upper and lower through holes 112, 122 in front corners on a right side of the upper and lower heat exchange plates 11, 12.

Therefore, in each of the second to fifth heat exchange units 10, when upper and lower gas vent flanges 11*c*, 12*c* at peripheral portions of upper and lower gas vents 11*a*, 12*a* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with the three lower through holes 121, 123, 124 in a rear corner on the right side and front and rear corners on a left side of the lower heat exchange plate 12, and communicates with the three upper through holes 111, 113, 114 in a rear corner on the right side and front and rear corners on the left side of the upper heat exchange plate 11.

Further, as described above, at the peripheral portions of the upper and lower through holes 111 to 114, 121 to 124 in the four corners of the first upper and lower heat exchange plates 11, 12 of the second to fifth heat exchange units 10, the upper and lower through hole flange portions that project outward when the upper and lower heat exchange plates 11, 12 are superimposed with each other are formed.

Accordingly, when the lower through hole flange portions in the four corners of the lower heat exchange plate 12 of one of the second to fifth heat exchange units 10 and the upper through hole flange portions in the four corners of the upper heat exchange plate 11 of a downward adjacent heat exchange unit 10 (including the upper heat exchange plate 11 of the first heat exchange unit 10) are joined, and a bottom peripheral edge of the lower heat exchange plate 12 and an upper peripheral edge joint W1 of the upper heat exchange plate 11 of the downward adjacent heat exchange unit 10 are joined, as shown in FIGS. 3 and 4, an exhaust space 15 and communication paths 22 defined in a non-communicating state with the exhaust space 15 are formed between the vertically adjacent heat exchange units 10.

That is, in each of the second to fifth heat exchange units 10, the three lower through holes 121, 123, 124 in the rear corner on the right side and the front and rear corners on the left side of the lower heat exchange plate 12 serve as inlet ports 23 through which the water flows into the internal space 14. In addition, the three upper through holes 111, 113, 114 of the upper heat exchange plate 11 facing the lower through holes 121, 123, 124 serve as outlet ports 24 through which the water flows out from the internal space 14.

Further, when the lower through hole flange portions at the peripheral portions of these three inlet ports 23 (that is, the three lower through holes 121, 123, 124 in the rear corner on the right side and the front and rear corners on the left side of the lower heat exchange plate 12) and the upper through hole flange portions at the peripheral portions of the outlet ports 24 (that is, the three upper through holes 111, 113, 114 in the rear corner on the right side and the front and rear corners on the left side of the upper heat exchange plate 11) of the upper heat exchange plate 11 of the downward adjacent heat exchange unit 10 are joined, the communication paths 22 are formed. The communication paths 22 serve as fluid flow paths for allowing the internal spaces 14 of the vertically adjacent heat exchange units 10 to communicate with each other.

Further, when the lower through hole flange portion in the front corner on the right side of the lower heat exchange plate 12 and the upper through hole flange portion in the front corner on the right side of the upper heat exchange plate 11 of the downward adjacent heat exchange unit 10 are joined, and the lead-out pipe 33 is inserted into the upper and lower through holes 112, 122, a fluid flow path which is defined in a non-communicating state with the internal spaces 14 and the exhaust spaces 15 is formed.

As illustrated in FIGS. 2 and 3, in a sixth heat exchange unit 10, upper and lower heat exchange plates 11, 12 have the same configurations as those of the second heat exchange unit 10, except that an upper through hole 111 (not illustrated) in a rear corner on a right side of the upper heat exchange plate 11 is sealed with a lid member 90. Therefore, in the sixth heat exchange unit 10, when upper and lower gas vent flanges 11*c*, 12*c* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with three lower through holes 121, 123, 124 in a rear corner on the right side and front and rear corners on a left side of the lower heat exchange plate 12, and communicates with two upper through holes 113, 114 in front and rear corners on the left side of the upper heat exchange plate 11.

Further, similarly to the above, when the fifth and sixth heat exchange units 10 are joined together, an exhaust space 15 and communication paths 22 defined in a non-communicating state with the exhaust space 15 are formed. That is, in the sixth heat exchange unit 10, the three lower through holes 121, 123, 124 in the rear corner on the right side and the front and rear corners on the left side of the lower heat exchange plate 12 serve as inlet ports 23 through which the water flows into the internal space 14. In addition, the two upper through holes 113, 114 in the front and rear corners on the left side of the upper heat exchange plate 11 serve as outlet ports 24 through which the water flows out from the internal space 14. Further, when lower through hole flange portions at peripheral portions of these three inlet ports 23 (that is, the three lower through holes 121, 123, 124 in the rear corner on the right side and the front and rear corners on the left side of the lower heat exchange plate 12) and upper through hole flange portions at peripheral portions of the outlet ports 24 (that is, the three upper through holes 111, 113, 114 in the rear corner on the right side and the front and rear corners on the left side of the upper heat exchange plate 11) of the upper heat exchange plate 11 of the downward adjacent heat exchange unit 10 are joined, communication paths 22 are formed. The communication paths 22 serve as fluid flow paths for allowing the internal spaces 14 of the vertically adjacent heat exchange units 10 to communicate with each other.

Further, when a lower through hole flange portion in a front corner on the right side of the lower heat exchange plate 12 and the upper through hole flange portion in the front corner on the right side of the upper heat exchange plate 11 of the downward adjacent heat exchange unit 10 are joined, the lead-out pipe 33 is inserted into a lower through hole 122, and an upper end of the lead-out pipe 33 is joined to a lower surface of an upper through hole flange portion of an upper through hole 112, a fluid flow path which is defined in a non-communicating state with the internal space 14 and the exhaust space 15 is formed. Further, as described above, the lead-out pipe 33 penetrates the internal spaces 14 of the first to sixth heat exchange units 10 and the exhaust spaces 15 between these heat exchange units 10 in the non-communicating state, and is connected to the lower through hole 122 in the front corner on the right side of the lower heat exchange plate 12 of the first heat exchange unit 10.

In the first to sixth heat exchange units 10, when these heat exchange units 10 are stacked, the inlet ports 23 and the outlet ports 24 in the front corner on the right side are located on a coaxial line. Therefore, part of the water flowing into the internal space 14 of the first heat exchange unit 10 flows linearly toward the upper outlet port 24, and flows into the internal space 14 of each of the second to sixth heat exchange units 10 from the outlet port 24 through the communication path 22. Therefore, part of the water flowing into the first to sixth heat exchange units 10 flows in the same direction (the right to the left in the drawing) of the left-right direction within the internal space 14 of each of the heat exchange units 10 while colliding with the flange portions 18.

In a seventh heat exchange unit 10, upper and lower heat exchange plates 11, 12 have the same configurations as those of the fifth heat exchange unit 10, except that the lead-out pipe 33 is not inserted into upper and lower through holes 112, 122 in a front corner on a right side (see FIGS. 2 and 4). Therefore, in the seventh heat exchange unit 10, when upper and lower gas vent flanges 11*c*, 12*c* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with all upper and lower through holes 111 to 114, 121 to 124.

Further, similarly to the above, when the sixth and seventh heat exchange units 10 are joined together, an exhaust space 15 and communication paths 22, 35 defined in a non-communicating state with the exhaust space 15 are formed. That is, in the seventh heat exchange unit 10, the two lower through holes 123, 124 in front and rear corners on a left side of the lower heat exchange plate 12 serve as inlet ports 23 through which the water flows into the internal space 14. In addition, the three upper through holes 111, 113, 114 in a rear corners on the right side and the front and rear corners on the left side of the upper heat exchange plate 11 serve as outlet ports 24 through which the water flows out from the internal space 14. Further, the lower through hole 122 in the front corner on the right side of the lower heat exchange plate 12 serves as an outlet port 24 through which the water flows out from the internal space 14 to the lead-out pipe 33. Furthermore, when lower through hole flange portions at peripheral portions of the two inlet ports 23 in the front and rear corners on the left side (that is, the two lower through holes 123, 124 in the front and rear corners on the left side of the lower heat exchange plate 12) and the upper through hole flange portions at the peripheral portions of the outlet ports 24 (that is, the two upper through holes 113, 114 in the front and rear corners on the left side of the upper heat exchange plate 11) of the upper heat exchange plate 11 of the downward adjacent heat exchange unit 10 are joined, the communication paths 22 are formed. The communication paths 22 serve as fluid flow paths for allowing the internal spaces 14 of the vertically adjacent heat exchange units 10 to communicate with each other.

Further, when a lower through hole flange portion in the front corner on the right side of the lower heat exchange plate 12 and an upper through hole flange portion in the front corner on the right side of the upper heat exchange plate 11 of the downward adjacent heat exchange unit 10 are joined, the communication path 35 defined in the non-communicating state with the exhaust space 15 are formed (see FIG. 4). Furthermore, as described above, the upper end of the lead-out pipe 33 is joined to the lower surface of the upper through hole flange portion in the front corner on the right side of the sixth upper heat exchange plate 11. Therefore, the internal space 14 of the seventh heat exchange unit 10 communicates with the lead-out pipe 33 via the communication path 35.

In the seventh heat exchange unit 10, part of the water flowing into the internal space 14 from the two inlet ports 23 in the front and rear corners on the left side flows, while colliding with flange portions 18, toward the two outlet ports 24 on the front and rear corners on the right side (that is, the upper through hole 111 in the rear corner on the right side of the upper heat exchange unit 11 and the lower through hole 122 in the front corner on the right side of the lower heat exchange unit 12) in a direction opposite to the direction of the water flowing in the internal spaces 14 of the first to sixth heat exchange units 10 (from the left to the right in the drawing).

In an eighth (uppermost) heat exchange unit 10 located on a most upstream side of the gas flow passage of the combustion exhaust gas, upper and lower heat exchange plates 11, 12 have the same configurations as those of the second heat exchange unit 10, except that the upper heat exchange plate 11 has the upper peripheral edge joint projecting downward, that the upper heat exchange plate 11 does not have an upper through hole, and that the lead-out pipe 33 is not inserted into a lower through hole 122. Therefore, in the eighth heat exchange unit 10, when upper and lower gas vent flanges 11*c*, 12*c* of the upper and lower heat exchange plates 11, 12 are joined, and a lower peripheral edge joint W2 of the lower heat exchange plate 12 and the upper peripheral edge joint of the upper heat exchange plate 11, an internal space 14 formed between the upper and lower heat exchange plates 11, 12 communicates with all lower through holes 121 to 124 of the lower heat exchange plate 12.

Further, similarly to the above, when the seventh and eighth heat exchange units 10 are joined together, an exhaust space 15 and communication paths 22, 35 defined in a non-communicating state with the exhaust space 15 are formed. That is, in the eighth heat exchange unit 10, the three lower through holes 121, 123, 124 in a rear corner on a right side and front and rear corners on a left side of the lower heat exchange plate 12 serve as inlet ports 23 through which the water flows into the internal space 14. In addition, the lower through hole 122 in a front corner on the right side of the lower heat exchange plate 12 serves as an outlet port 24 through which the water flows out from the internal space 14. Furthermore, when lower through hole flange portions at peripheral portions of the three inlet ports 23 (that is, the three lower through holes 121, 123, 124 in the rear corner on the right side and the front and rear corners on the left side of the lower heat exchange plate 12) and the upper through hole flange portions at the peripheral portions of the outlet ports 24 (that is, the three upper through holes 111, 113, 114 in the rear corner on the right side and the front and rear corners on the left side of the upper heat exchange plate 11) of the upper heat exchange plate 11 of the downward adjacent heat exchange unit 10 are joined, the communication paths 22 are formed. The communication paths 22 serve as fluid flow paths for allowing the internal spaces 14 of the vertically adjacent heat exchange units 10 to communicate with each other.

Further, when a lower through hole flange portion in the front corner on the right side of the lower heat exchange plate 12 and the upper through hole flange portion in the front corner on the right side of the upper heat exchange plate 11 of the downward adjacent heat exchange unit 10 are joined, the communication path 35 defined in the non-communicating state with the exhaust space 15 is formed. That is, the internal spaces 14 of the seventh and eighth heat exchange units 10 communicate with each other through the communication paths 22 through which the water flows upward from below and the communication path 35 through which the water flows downward from above. Further, the internal space 14 of the eighth heat exchange unit 10 communicates with the lead-out pipe 33 via the internal space 14 of the seventh heat exchange unit 10.

In the seventh to eighth heat exchange units 10, when these heat exchange units 10 are stacked, the inlet ports 23 and the outlet ports 24 positioned in the same corner among the front and rear corners on the left side are located on a coaxial line. Therefore, part of the water flowing from the one inlet port 23 into the internal space 14 of the seventh heat exchange unit 10 flows linearly toward the upper outlet port 24, and flows into the internal space 14 of the eighth heat exchange unit 10 from the outlet port 24 through the communication path 22. Therefore, part of the water flowing into the seventh to eighth heat exchange units 10 flows in the same direction (the left to the right in the drawing) of the left-right direction within the internal space 14 of each of the heat exchange units 10 while colliding with the flange portions 18.

Further, since the outlet ports 24 in the front corners on the right side of the seventh and eighth heat exchange units 10 communicate with the lead-out pipe 33, the water having reached the seventh and eighth heat exchange units 10 flows downward through the lead-out pipe 33. In other words, part of the water flowing in the seventh heat exchange unit 10 flows out to the lead-out pipe 33 from the outlet port 24 in the front corner on the right side of the seventh heat exchange unit 10 without flowing into the eighth heat exchange unit 10. Therefore, the outlet port 24 in the front corner on the right side of the eighth heat exchange unit 10 and the outlet port 24 in the front corner on the right side of the seventh heat exchange unit 10 (that is, the lower through holes 122 in the front corners on the right side of the lower heat exchange plates 12 of these heat exchange units 10) form final outlet ports through which the water flows out to the outlet pipe 21 via the lead-out pipe 33. As described above, in the present embodiment, the water flowing into the heat exchanger 1 from the inlet pipe 20 flows the lower side toward the upper side in the heat exchange units 10 stacked in the vertical direction. Then, a direction of the fluid flow path is folded back in the stacked body 100 so that the water is directed from the upper side toward the lower side, and the water flows from the seventh or eighth heat exchange unit 10 through the lead-out pipe 33 to the outlet pipe 21.

Figure 5:
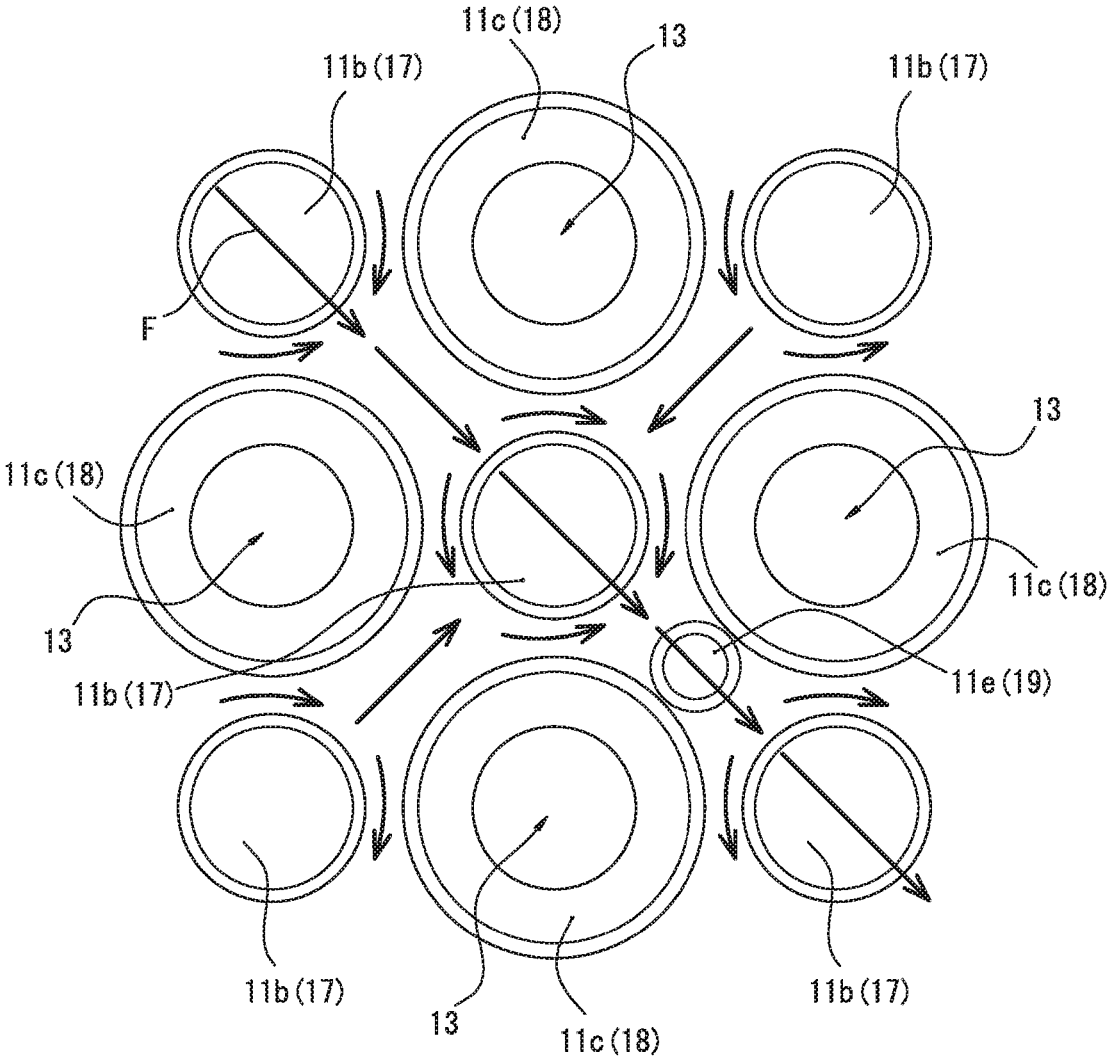
FIG. 5 is a schematic enlarged partial plan view showing the heat exchanger according to the embodiment of the present invention.

Next, flow of water in the internal space 14 of each heat exchange unit 10 will be described. FIG. 5 is a schematic partial plan view illustrating flow of water in the internal space 14 when a part of one heat exchange unit 10 is viewed from above, and FIG. 6 is a schematic partial enlarged cross-sectional view illustrating flow of water in the internal space 14 of a part of one heat exchange unit 10. In these drawings, an arrow F denotes flow of water and an arrow G denotes flow of combustion exhaust gas.

As described above, water flows in the internal space 14 of each of the heat exchange units 10 in the left-right direction from the inlet port 23 toward the outlet port 24. At this time, water tends to flow through a low flow resistance region of the internal space 14. Thus, when the inwardly directed step portion 17 is not formed between the adjacent gas vents 13, water easily flows through a center region between flange portions 18 that is away from the flange portions 18 closing the internal space 14. As a result, water flowing near the flange portions 18 is reduced, and moreover, laminar flow tends to be formed at the center region between the flange portions 18. Thus, a temperature difference between the temperature of water flowing near the flange portions 18 and the temperature of water flowing through the center region between the flange portions 18 increases, and a temperature distribution of the water flowing in the internal space 14 increases. As a result, heat of the combustion exhaust gas is not sufficiently absorbed by the heat exchange unit 10. Further, heat absorbed by the flange portion 18 is not sufficiently transferred to the water flowing through the internal space 14, and thermal efficiency tends to decrease.

However, in the heat exchanger 1 of the present embodiment, since the inwardly directed step portion 17 reducing the height of the internal space 14 is formed between the adjacent gas vents 13, the inwardly directed step portion 17 projects inwardly of the internal space 14. Consequently, as illustrated in FIG. 5, water colliding with a periphery of the inwardly directed step portion 17 is divided into water flowing straight through the narrow internal space **14*a* toward the downstream side and water flowing around the periphery of the inwardly directed step portion 17 toward the downstream side. Therefore, water flowing around the periphery of the inwardly directed step portion 17 flows near the flange portion 18. Thus, heat of the flange portion 18** heated to a high temperature can be efficiently transferred to water.

Further, water flowing from the upstream side in the internal space 14 collides with the inwardly directed step portion 17, thereby generating turbulence of water. Therefore, a temperature distribution of water on the upstream side of the inwardly directed step portion 17 can be reduced. Thus, heat absorbed by the heat exchange unit 10 can be efficiently transferred to water.

Further, the gas vents 13 and the inwardly directed step portions 17 are both formed in the lattice shape over substantially the entire surface of the heat exchange unit 10, and the gas vents 13 and the inwardly directed step portions 17 are alternately formed at substantially equal intervals in the front-rear and left-right directions. Consequently, toward the inwardly directed step portion 17 located between one pair of adjacent gas vents 13, water passing between another pair of adjacent gas vents 13 flows. Thus, turbulence of water is facilitated, whereby the temperature distribution of water flowing near the inwardly directed step portion 17 can be further reduced.

Further, as illustrated in FIG. 6, a distance in the vertical direction between water passing through the narrow internal space **14*a* and an inner surface of the heat exchange unit 10 decreases. Thus, heat absorbed by the heat exchange unit 10** can be efficiently transferred to water.

Further, as illustrated in FIG. 5, water passing through the narrow internal space **14*a* and water flowing around the inwardly directed step portion 17 merge again on the downstream side of the inwardly directed step portion 17, thereby generating a turbulent flow of water. Therefore, a temperature distribution of water on the downstream side of the inwardly directed step portion 17 can be reduced. Thus, heat absorbed by the heat exchange unit 10** can be efficiently transferred to water.

Further, as illustrated in FIG. 6, since water having passed through the narrow internal space 14*a* flows so as to spread in the vertical direction on the downstream side of the inwardly directed step portion 17, there are many flow components flowing in the vertical direction on the downstream side of the inwardly directed step portion 17. On the other hand, since water flowing around the inwardly directed step portion 17 flows through the internal space 14 having a constant height, there are less flow components flowing in the vertical direction. Accordingly, on the downstream side of the inwardly directed step portion 17, water having flow components in different directions is merged, whereby turbulence of water is facilitated. Thus, a temperature distribution of water on the downstream side of the inwardly directed step portion 17 can be reduced.

Further, since the outwardly directed step portion 19 for increasing the height of the internal space 14 is formed at the substantially center of the region surrounded by two adjacent gas vents 13 and two adjacent inwardly directed step portions 17, as illustrated in FIG. 6, turbulence of water is generated when the water merged on the downstream side of the inwardly directed step portion 17 described above flows into the wide internal space 14*b*. Therefore, a temperature distribution of water on the downstream side of the inwardly directed step portion 17 can be reduced. Thus, heat absorbed by the heat exchange unit 10 can be efficiently transferred to water.

Since the height of the internal space 14 is reduced by the inwardly directed step portion 17, irregularities are formed on the outer surface between the two adjacent gas vents 13 of the heat exchange unit 10. In addition, the gas vents 13 of the vertically adjacent heat exchange units 10 are shifted by a half pitch in the left-right direction, and the inwardly directed step portion 17 is located between the adjacent gas vents 13. Therefore, the inwardly directed step portion 17 of the lower heat exchange unit 10 is positioned below the gas vent 13 of the upper heat exchange unit 10. Accordingly, the combustion exhaust gas flowing through the exhaust space 15 collides with the irregularities formed by the upper recess 11*b* before flowing into the gas vent 13 of the lower heat exchange unit 10, thereby generating turbulence of the combustion exhaust gas. Therefore, it is possible to thin a temperature boundary layer of the combustion exhaust gas at the peripheral portion of the gas vent 13. Thus, heat of the combustion exhaust gas can be efficiently absorbed by the flange portion 18.

Further, since the exhaust space 15 through which the combustion exhaust gas flows is formed between the vertically adjacent heat exchange units 10, heat of the combustion exhaust gas can be absorbed by the upper and lower heat exchange plates 11, 12. Thus, heat absorbed by the heat exchange unit 10 can be efficiently transferred to water.

Since the burring portion 11*d* formed at the inner end of the flange portion 18 extends toward the downstream side of the gas flow passage of the combustion exhaust gas from the opening edge of the gas vent 13, when the combustion exhaust gas passes through the gas vent 13, the combustion exhaust gas flows toward the downstream side while coming into contact with the burring portion 11*d*. Therefore, since the heat absorption area increases, heat of the combustion exhaust gas is efficiently absorbed by the flange portion 18. Thus, heat absorbed by the heat exchange unit 10 can be efficiently transferred to water.

Preferably, the burring portion 11*d* is formed in a tapered shape so that a hole diameter thereof decreases toward the downstream side of the combustion exhaust gas. Thus, it is possible to increase the heat absorption area, while reducing flow resistance of the combustion exhaust gas.

Note that the burring portion 11*d* may be formed at an inner end of the lower gas vent flange portion 12*c* so as to extend toward the upstream side of the combustion exhaust gas from the opening edge of the gas vent 13. In such a case, turbulence of the combustion exhaust gas tends to generate by the burring portion 11*d* before the combustion exhaust gas flows into the gas vent 13. Therefore, it is possible to thin a temperature boundary layer of the combustion exhaust gas at the peripheral portion of the gas vent 13. Thus, heat of the combustion exhaust gas can be efficiently absorbed by the flange portion 18.

As described above, in the heat exchanger 1, since heat absorbed from the combustion exhaust gas by the heat exchange unit 10 is efficiently transferred to water flowing through the internal space 14, heat exchange is facilitated. According to an examination by the present inventor, thermal efficiency of the heat exchanger 1 using the heat exchange unit 10 having the inwardly directed step portion 17 of the present embodiment is approximately 88%. On the other hand, thermal efficiency of a comparative heat exchanger using a heat exchange unit without the inwardly directed step portion 17 is approximately 86%. Therefore, according to the present invention, the heat exchanger 1 having high thermal efficiency can be provided.

In the above embodiment, the lead-out pipe 33 penetrating the first to sixth heat exchange units 10 is provided. However, a lead-out pipe 33 penetrating the first to seventh heat exchange units 10 may be provided. In such a case, entire water flows into the internal space 14 of the eighth heat exchange unit 10, and the water flows from the outlet port 24 of the eighth heat exchange unit 10 through the lead-out pipe 33 to the outlet pipe 21.

In the above embodiment, the lead-out pipe 33 penetrating the first to sixth heat exchange units 10 and the outlet pipe 21 are connected so as to allow water to flow out from the heat exchanger 1. However, without using the lead-out pipe 33, a lead-out flow path communicating with the outlet pipe 21 may be formed by forming burring portions at peripheral portions of the upper and lower through holes at predetermined positions and joining the burring portions.

In the above embodiment, the burner 31 having the downward combustion surface 30 is disposed above the heat exchanger 1. However, a burner having an upward combustion surface may be disposed below the heat exchanger.

In the embodiment above, the plurality of heat exchange units 10 are stacked in the vertical direction. However, a plurality of heat exchange units 10 may be stacked in the left-right direction.

In the above embodiment, the vertically adjacent heat exchange units 10 are stacked in such a manner that the exhaust space 15 is formed therebetween. However, a plurality of heat exchange units 10 may be stacked without providing the exhaust space 15.

In the above embodiment, the water heater is used. However, a heat source device such as a boiler may be used.

As described in detail, the present invention is summarized as follows.

According to one aspect of the present invention, there is provided a heat exchanger comprising a plurality of heat exchange units stacked in a direction of a gas flow passage of combustion exhaust gas, wherein each of the plurality of heat exchange units includes:

an internal space through which a fluid to be heated flows;

a plurality of gas vents penetrating the internal space in a non-communicating state and through which the combustion exhaust gas passes; and an inwardly directed step portion reducing a height of the internal space between adjacent gas vents.

According to the heat exchanger described above, since the height of the internal space is reduced by the inwardly directed step portion, the inwardly directed step portion projects inwardly of the internal space. Consequently, the fluid to be heated flowing from an upstream side of the inwardly directed step portion collides with a periphery of the inwardly directed step portion to be divided into one part of the fluid to be heated flowing straight through an narrow internal space formed by the inwardly directed step portion toward a downstream side of a fluid flow path and another part of the fluid to be heated flowing around the periphery of the inwardly directed step portion toward the downstream side of the fluid flow path. Since the inwardly directed step portion is formed between the adjacent gas vents, the fluid to be heated flowing around the inwardly directed step portion flows near a peripheral portion of the gas vent. Thus, heat of the peripheral portion of the gas vent heated to a high temperature can be efficiently transferred to water.

Further, the fluid to be heated collides with the periphery of the inwardly directed step portion, thereby generating turbulence of the fluid to be heated. Therefore, a temperature distribution of the fluid to be heated on the upstream side of the inwardly directed step portion can be reduced. Thus, heat absorbed by the heat exchange unit can be efficiently transferred to the fluid to be heated.

Further, since the height of the internal space is reduced by the inwardly directed step portion, a distance between the fluid to be heated passing through the narrow internal space formed by the inwardly directed step portion and an inner surface of the heat exchange unit decreases. Thus, heat absorbed by the heat exchange unit can be efficiently transferred to the fluid to be heated.

Further, the fluid to be heated passing through the narrow internal space formed by the inwardly directed step portion and the fluid to be heated flowing around the inwardly directed step portion merge again on the downstream side of the inwardly directed step portion, thereby generating a turbulent flow of the fluid to be heated. Therefore, a temperature distribution of the fluid to be heated on the downstream side of the inwardly directed step portion can be reduced. Thus, heat absorbed by the heat exchange unit can be efficiently transferred to the fluid to be heated.

Preferably, in the heat exchanger, each of the plurality of heat exchange units includes a flange portion closing the internal space at a peripheral portion of each of the gas vents.

According to the heat exchanger described above, since the flange portion closing the internal space at the peripheral portion of the gas vent is formed, heat of the combustion exhaust gas can be efficiently absorbed by the flange portion when the combustion exhaust gas passes through the gas vent. Further, since the inwardly directed step portion is formed between the flange portions formed at the peripheral portions of the adjacent gas vents, heat absorbed by the flange portion can be efficiently transferred to the fluid to be heated.

Preferably, in the heat exchanger, the gas vent and the inwardly directed step portion are alternately formed in at least one of front-rear and left-right directions of each of the heat exchange units.

According to the heat exchanger described above, heat absorbed by the heat exchange unit can be efficiently transferred to the fluid to be heated. Further, the gas vent and inwardly directed step portion are alternately formed in at least one of front-rear and left-right directions of each of the heat exchange units. Therefore, toward the inwardly directed step portion located between one pair of adjacent gas vents, the fluid to be heated passing between another pair of adjacent gas vents flows. Thus, the turbulence of the fluid to be heated is facilitated, whereby the temperature distribution of the fluid to be heated can be further reduced.

Preferably, in the heat exchanger, each of the plurality of heat exchange units includes an outwardly directed step portion increasing the height of the internal space within a region surrounded by the adjacent gas vents and adjacent inwardly directed step portions.

According to the heat exchanger described above, since the outwardly directed step portion is located within the region surrounded by the adjacent gas vents and the adjacent inwardly directed step portions, turbulence of the fluid to be heated is generated when the fluid to be heated flows into a wide internal space formed by the outwardly directed step portion. Therefore, a temperature distribution of the fluid to be heated can be reduced. Thus, heat absorbed by the heat exchange unit can be efficiently transferred to the fluid to be heated.

Preferably, in the heat exchanger, the flange portion has a burring portion extending from an opening edge of the gas vent toward an upstream side or a downstream side of the gas flow passage of the combustion exhaust gas.

According to the heat exchanger described above, since the combustion exhaust gas passes through the gas vent while coming into contact with the burring portion, a heat absorption area increases. Further, if the burring portion extends toward the upstream side of the gas flow passage of the combustion exhaust gas, turbulence of the combustion exhaust gas is generated by the burring portion when the combustion exhaust gas flows into the gas vent. Therefore, a temperature boundary layer of the combustion exhaust gas at the peripheral portion of the gas vent becomes thinner, so that heat of the combustion exhaust gas can be efficiently absorbed by the flange portion. Thus, heat absorbed by the heat exchange unit can be efficiently transferred to the fluid to be heated.

Preferably, in the heat exchanger, the burring portion has a tapered shape in such a manner that a hole diameter of the gas vent decreases toward the downstream side of the gas flow passage of the combustion exhaust gas.

According to the heat exchanger described above, flow resistance of the combustion exhaust gas flowing into the gas vent can be reduced. Further, when the combustion exhaust gas passes through the gas vent, a contact time between the combustion exhaust gas and the burring portion having the tapered shape becomes longer. Therefore, heat of the combustion exhaust gas can be absorbed by the flange portion and the burring portion. Thus, heat absorbed by the heat exchange unit can be efficiently transferred to the fluid to be heated.

Preferably, the heat exchanger, further comprises an exhaust space between adjacent heat exchange units, wherein the exhaust space communicates with the gas vents of the adjacent heat exchange units and through which the combustion exhaust gas flows.

According to the heat exchanger described above, since heat of the combustion exhaust gas can be absorbed by both surfaces of each of the heat exchange units, heat absorbed by the heat exchange unit can be efficiently transferred to the fluid to be heated. Further, since the height of the internal space reduces at a region where the inwardly directed step portion is formed, irregularities are formed on an outer surface between the adjacent gas vents. As a result, when the combustion exhaust gas collides with the irregularities, turbulence of the combustion exhaust gas is generated, whereby a temperature boundary layer of the combustion exhaust gas at the peripheral portion of the gas vent becomes thinner. Thus, heat of the combustion exhaust gas can be efficiently absorbed by the peripheral portion of the gas vent.

Preferably, in the heat exchanger, each of the plurality of heat exchange units includes a pair of upper and lower heat exchange plates superimposed with each other, wherein the upper and lower heat exchange plates have a plurality of upper and lower gas vents penetrating thereof and a plurality of upper and lower recesses projecting inward when the pair of upper and lower heat exchange plates are superimposed with each other, respectively, wherein the upper and lower recesses are formed between adjacent upper and lower gas vents, respectively.

According to the heat exchanger described above, when the pair of upper of upper and lower heat exchange plates are superimposed with each other, the internal space through which the fluid to be heated flows is formed therebetween. In addition, the gas vents penetrating the internal space in the non-communicating state are formed by the upper and lower gas vents of the upper and lower heat exchange plates. Further, the inwardly directed step portions reducing the height of the internal space between the upper of upper and lower heat exchange plates are formed between the adjacent gas vents by the upper and lower recesses.

The present application claims a priority based on a Japanese Patent Application No. 2018-150471 filed on Aug. 9, 2018, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A heat exchanger comprising:

a plurality of heat exchange units stacked in a direction of a gas flow passage of combustion exhaust gas, each of the plurality of heat exchange units including:

an internal space through which a fluid to be heated is to flow;

a plurality of gas vents penetrating through the internal space so as not to communicate with the internal space and through which the combustion exhaust gas passes;

a plurality of inwardly directed step portions, each of the inwardly directed step portions reducing a height of the internal space; and a plurality of outwardly directed step portions, each of the outwardly directed step portions increasing a height of the internal space, wherein the gas vents and the inwardly directed step portions are alternately positioned with respect to both a front-rear direction and a left-right side direction of each of the heat exchange units, and wherein each of the outwardly directed step portions is surrounded by an adjacent set of the gas vents and an adjacent set of the inwardly directed step portions.

2. The heat exchanger according to claim 1, wherein each of the plurality of heat exchange units includes a flange portion closing the internal space at a peripheral portion of each of the gas vents.

3. The heat exchanger according to claim 2, wherein the flange portion of each of the gas vents has a burring portion extending from an opening edge of each of the gas vents toward an upstream side or a downstream side of the gas flow passage of the combustion exhaust gas.

4. The heat exchanger according to claim 3, wherein the burring portion has a tapered shape such that a hole diameter of each of the gas vents decreases along a direction toward the downstream side of the gas flow passage of the combustion exhaust gas.

5. The heat exchanger according to claim 1, wherein the heat exchange units are stacked to form an exhaust space between adjacent heat exchange units, wherein the exhaust space communicates with the gas vents of the adjacent heat exchange units and through which the combustion exhaust gas flows.

6. The heat exchanger according to claim 1, wherein each of the plurality of heat exchange units includes a pair of upper and lower heat exchange plates superimposed with each other, wherein the pair of upper and lower heat exchange plates of each of the heat exchange units have a plurality of upper and lower gas vents penetrating thereof and a plurality of upper and lower recesses projecting inwardly into the internal space when the pair of upper and lower heat exchange plates are superimposed with each other, wherein the upper and lower recesses are formed between respective adjacent upper and lower gas vents such that each of the upper and lower recesses forms the inwardly directed step portion when the pair of upper and lower heat exchange plates are superimposed with each other.

* * * * *